US005918606A

United States Patent [19]

Bilotto

[11] Patent Number: 5,918,606

[45] Date of Patent: Jul. 6, 1999

[54] MANICURE SHIELD

[76] Inventor: Vinnie Bilotto, 10205 Central Northwest, Albuquerque, N.M. 87121-7626

[21] Appl. No.: 09/210,900

[22] Filed: Dec. 16, 1998

[51] Int. Cl.[6] ..... A45D 29/00

[52] U.S. Cl. ..... 132/73; 248/118

[58] Field of Search ..... 132/73, 73.5, 75, 132/319, 333; 248/118, 118.1, 118.5, 460, 165, 451

[56] References Cited

U.S. PATENT DOCUMENTS

| | | | |
|---|---|---|---|
| D. 289,346 | 4/1987 | Arato . | |
| D. 373,445 | 9/1996 | Wright-Godley . | |
| 2,378,935 | 6/1945 | Kraft | 132/73 |
| 2,490,356 | 12/1949 | Hummel . | |
| 2,523,755 | 9/1950 | Ford et al. . | |
| 2,982,568 | 5/1961 | Wolfe . | |
| 4,329,002 | 5/1982 | Cowen et al. | 248/118 |
| 4,332,263 | 6/1982 | Kitrell | 132/73 |
| 4,378,102 | 3/1983 | Portis, Jr. et al. | 248/460 |
| 5,103,845 | 4/1992 | Matthews | 132/73 |
| 5,169,103 | 12/1992 | Jimenez et al. | 248/118 |
| 5,184,795 | 2/1993 | Sexton | 248/118 |

FOREIGN PATENT DOCUMENTS

| | | |
|---|---|---|
| 9576 | 1/1912 | United Kingdom . |
| 514148 | 10/1939 | United Kingdom . |
| 988752 | 4/1965 | United Kingdom . |

*Primary Examiner*—Gene Mancene
*Assistant Examiner*—Pedro Philogene
*Attorney, Agent, or Firm*—Stephen R. Greiner

[57] ABSTRACT

A manicure shield including a padded base for propping up the forearms of a manicure patron. A support is secured to the padded base and extends upwardly from one of its sides. A transparent book holder is secured to the support and is spaced from the padded base at a distance sufficient to allow the hands of the patron to be positioned between the padded base and the transparent book holder. A transparent panel is hingedly connected to the top of the transparent book holder to shield the faces of the patron and manicurist from debris ejected from the patron's fingernails and from airborne germs.

8 Claims, 1 Drawing Sheet

MANICURE SHIELD

FIELD OF THE INVENTION

The present invention relates generally to supports and, more particularly, to book or printed copy holders.

BACKGROUND OF THE INVENTION

Fingernails reflect the state of a person's health. Changes in fingernail color, texture and shape occur with some illnesses. Brittle, cracked fingernails may be due to a dietary deficiency. They may also be caused by the overuse of fingernail polish remover. Nervous persons often bite their nails.

Many individuals employ the services of a manicurist to keep their fingernails looking their best. During a manicure, the manicurist and patron sit face-to-face as the patron's fingernails are soaked, cleaned, trimmed and polished. These steps are often time consuming and permit the transfer of airborne, illness-causing germs between the patron and manicurist. Thus, a need presently exists for a product that will inhibit the spread of germs between a patron and manicurist and will neither impede the work of the manicurist nor alarm the patron in any way.

SUMMARY OF THE INVENTION

Because illness-causing germs can be easily spread while manicures are being performed, it is a principal object of the present invention to provide a multipurpose shield which will separate the faces of a manicurist and patron from one another.

It is another object of the invention to provide a shield of the type described which isolates both manicurist and patron from matter ejected from the patron's fingernails during a manicure.

It is a further object of the invention to provide a manicure shield of the type described which comfortably props up the arms of a patron while a manicure is being performed.

Still another object of the invention is to provides a manicure shield of the type described which will support reading materials in an orientation where a patron can easily review them while a manicure is being performed.

It is an object of the invention to provide improved elements and arrangements thereof in a manicure shield for the purposes described which is lightweight in construction, dependable in use and inexpensive to manufacture.

Briefly, the manicure shield in accordance with this invention achieves the intended objects by featuring a padded base for propping up the forearms of a manicure patron. A book holder is secured by a rigid support to the base and is spaced therefrom at a distance sufficient to allow the hands of the patron to be positioned between the base and the book holder so that a manicurist can access the hands. A transparent panel is hingedly secured to the top of the book holder to, among other things, shield the manicurist's and patron's eyes from flying debris.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
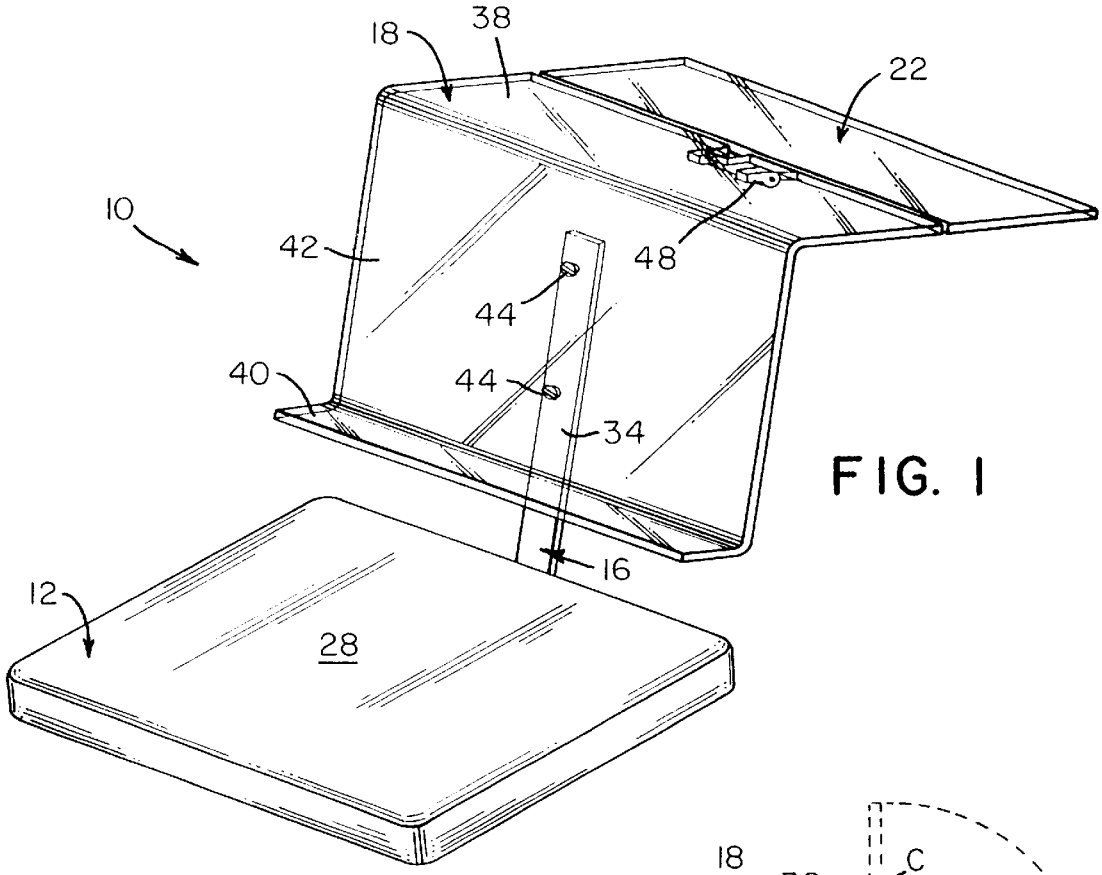
FIG. 1 is a perspective view of a manicure shield in accordance with the present invention.

Referring now to the FIGS., a manicure shield in accordance with the present invention is shown at 10. The shield 10 includes a padded base 12 on which a patron's forearms 14 may be rested during a manicure. An L-shaped support 16 is affixed to the base 12 and retains a book holder 18 at a set height above the base and the patron's hands 20. Pivotally secured to the book holder 18 is a transparent panel 22 for selectively shielding the eyes of a manicurist from material ejected from the fingernails of the patron.

The base 12 preferably includes a rectangular base plate 24 formed of a dense material such as wood or metal. The plate 24 is covered on its top and sides with a suitable padding 26 such as open-celled foam. The padding 26 is jacketed with a protective covering of vinyl sheeting or cloth 28. The uncovered bottom of the plate 24 has a shallow channel 30 extending at right angles from one side thereof.

The L-shaped support 16 is preferably formed of metal as an integral unit and includes a pair of legs 32 and 34 joined together at an obtuse angle. One leg 32 is secured within the channel 30 by means of threaded fasteners 36 which penetrate the plate 24. The other leg 34 extends upwardly and outwardly from the base 12.

The book holder 18 is integrally formed from a transparent plastic material so as to include a top plate 38 and a bottom plate 40 connected in an S-shape by an intermediate plate 42. As shown, the intermediate plate 42 is affixed to the front of the leg 34 by threaded fasteners 44 and is sized to support an opened book 46. The bottom plate 40 extends forwardly from the bottom of the intermediate plate 42 and serves as a ledge to retain the book 46 in an elevated position. The top plate 38, on the other hand, extends rearwardly from the top of the intermediate plate 42 and serves, at all times, as an eye protector for the manicurist.

Figure 2:
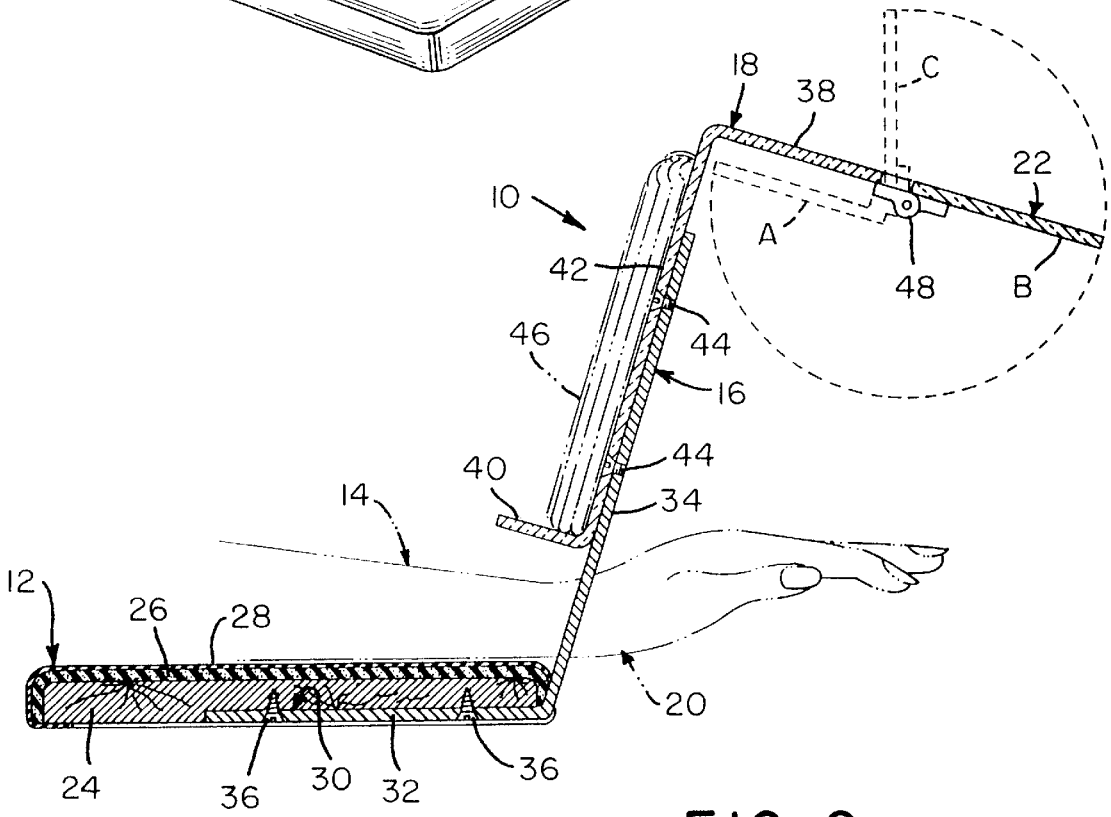
FIG. 2 is a cross-sectional view of the manicure shield of FIG. 1.

The transparent panel 22 is secured by a hinge 48 to the rearward edge of the top plate 38. The hinge 48 is preferably of the type which will support the weight of the panel 22 at any orientation set by the manicurist or patron. Thus, the panel 22 may be rotated upwardly from its storage position shown by broken line position A in FIG. 2 to solid line position B to increase the size of the barrier between the manicurist and patron's hands 20 or may be rotated even further to broken line position C to deflect some of the airborne germs that could otherwise pass between the manicurist and patron.

Typically, the weight of the base 12 would be adjusted at the time of its construction to offset the tendency of the book-loaded shield 10 to tip over. If it is desired to make the shield 10 as lightweight as possible, however, the base 12 may be formed of a low density material and, prior to use, such may be attached by double-sided adhesive tape or threaded fasteners (neither shown) to its supporting surface.

Use of the manicure shield 10 is straightforward. First, the shield 10 is positioned on a supporting surface with the base 12 in front of the patron. The patron then positions her forearms 14 atop the base 12 with her hands 20 extending beneath the book holder 18 on opposite sides of the leg 34.

With the book holder 18 now positioned before her eyes, the patron can easily read book 46 while a manicure is being performed.

In order to protect a manicurist's eyes, the trimming and polishing steps of a manicure will typically be performed with the patron's hands 20 positioned under both the top plate 38 and the laterally-extended panel 22. When shielding from flying debris is not required, however, the panel 22 can be elevated to a vertical orientation for optimum visibility of the hands 20. The panel 22, in an elevated position, serves to reduce the spreading of airborne germs between the patron and manicurist while they talk to one another. After the manicure is performed, the panel 22 may be rotated to a position beneath the top plate 38 for convenient storage. At no point during the use of the shield 10 does a manicurist ever need to stop working in order to put on cumbersome safety glasses to protect her eyes.

While the invention has been described with a high degree of particularity, it will be appreciated by those skilled in the art that modifications may be made thereto. For example, the top plate 38 may be eliminated, if desired, and the panel 22 may be hingedly connected directly to the top of intermediate plate 42. Therefore, it is to be understood that the present invention is not limited to the sole embodiment described above, but encompasses any and all embodiments within the scope of the following claims.

I claim:

1. A manicure shield, comprising:

a padded base for propping up the forearms of a user;

a support secured to said padded base and extending upwardly therefrom;

a book holder secured to said support and spaced from said padded base at a distance sufficient to allow the hands of user to be positioned between said padded base and said book holder.

2. The manicure shield according to claim 1 further comprising a panel hingedly connected to the top of said book holder.

3. The manicure shield according to claim 2 wherein said book holder and said panel are formed of a transparent material.

4. A manicure shield, comprising:

a padded base for propping up the forearms of a user, said padded base including:

a base plate having a channel in its bottom which terminates at one side thereof;

a padding material encasing the top and sides of said base plate; and, a protective covering positioned atop said padding material;

an L-shaped support having a first leg and a second leg secured together at an obtuse angle, said first leg being positioned within said channel and affixed to said base plate, said second leg extending upwardly and outwardly from said base plate; and, a book holder secured to said support and spaced from said padded base at a distance sufficient to allow the hands of user to be positioned between said padded base and said book holder, said book holder including:

an intermediate plate secured to said second leg of said L-shaped support; and, a bottom plate secured to the bottom of said intermediate plate and extending at right angles therefrom above said padded base.

5. The manicure shield according to claim 4 wherein said book holder further includes a top plate secured to the top of said intermediate plate and extending from said top plate in a direction substantially opposed to that of said bottom plate.

6. The manicure shield according to claim 4 further comprising a panel hingedly connected to the top of said intermediate plate.

7. The manicure shield according to claim 6 wherein said book holder and said panel are formed of a transparent material.

8. A manicure shield, comprising:

a padded base for propping up the forearms of a user;

a support secured to said padded base and extending upwardly from one side thereof;

a transparent book holder secured to said support and spaced from said padded base at a distance sufficient to allow the hands of user to be positioned between said padded base and said transparent book holder; and, a transparent panel hingedly connected to the top of said transparent book holder.

* * * * *